United States Patent [19]

Steers et al.

[11] Patent Number: 4,752,768

[45] Date of Patent: Jun. 21, 1988

[54] INTRUDER DETECTOR WITH ANTI-OBSCURING MEANS

[75] Inventors: Michel Steers, La Queue-en-Brie; Jean-Pierre Hazan, Sucy-en-Brie, both of France

[73] Assignee: U.S. Philips Corp., New York, N.Y.

[21] Appl. No.: 800,889

[22] Filed: Nov. 22, 1985

[30] Foreign Application Priority Data

Nov. 30, 1984 [FR] France ..... 84 18288

[51] Int. Cl.[4] ..... G08B 13/18

[52] U.S. Cl. ..... 340/567; 250/221; 250/342; 250/353; 340/552

[58] Field of Search ..... 340/567, 565, 552, 555, 340/600, 550; 250/338, 495.1, 504 R, 342, 353, 221

[56] References Cited

U.S. PATENT DOCUMENTS

| | | | |
|---|---|---|---|
| 3,858,043 | 12/1974 | Sick et al. | 340/555 |
| 4,119,949 | 10/1978 | Lindgren | 340/600 |
| 4,242,669 | 12/1980 | Crick | 340/567 |
| 4,656,462 | 4/1987 | Araki et al. | 340/556 |

FOREIGN PATENT DOCUMENTS

| | | | |
|---|---|---|---|
| 1603306 | 11/1981 | United Kingdom . | |
| 2141228 | 12/1984 | United Kingdom | 340/555 |

*Primary Examiner*—Joseph A. Orsino
*Assistant Examiner*—Brian R. Tumm
*Attorney, Agent, or Firm*—Thomas A. Briody; Jack E. Haken

[57] ABSTRACT

An apparatus for detecting intruders comprising a housing provided with at least one window, a passive infrared detector (for detecting the radiation emitted by an intruder around a wavelength $\lambda_1$), and an anti-obscuring device (detecting by infrared radiation having a wavelength $\lambda_2$ the presence of an obscuring of the appparatus for detecting intruders). The apparatus further includes an electronic circuit intended to operate an alarm when the presence of an intruder or an obscuring element has been detected. The apparatus for detecting intruders has a detector for detecting an obscuring element arranged at small and at large distances. It further includes a self-verification circuit. An obscuring element is detected, inter alia, by a mirror arranged at the end of the zone to be supervised, which returns radiation $\lambda_2$ emitted by an emitter to a detector, both being situated very close to the detector of radiation having a wavelength $\lambda_1$.

6 Claims, 2 Drawing Sheets

INTRUDER DETECTOR WITH ANTI-OBSCURING MEANS

BACKGROUND OF THE INVENTION

The invention relates to an apparatus for detecting intruders. The intruder detector consists of a housing provided with at least one window, a passive infrared detector (for detecting the radiation emitted by an intruder around a wavelength $\lambda_1$), and anti-obscuring means. The anti-obscuring means detects infrared radiation having a wavelength $\lambda_2$ which indicates the presence of an obscuring of the apparatus for detecting intruders. The detector further includes as electronic means for operating an alarm system when the presence of an intruder or of an obscuring element has been detected.

A device of this kind is described in British Pat. GB 1,603,306 (corresponding to U.S. Pat. No. 4,242,669). This patent discloses a passive infrared apparatus for detecting intruders. It comprises a pyroelectric detector which detects the infrared emission produced by a living creature (and more particularly by an intruder entering, without authorization, a room to be supervised). The principle of such an apparatus is to detect variations of infrared emission. Variations are obtained by segmenting the scrutinization of the zone to be supervised by the use of a network of mirrors focusing the emitted infrared radiation on the pyroelectric detector. This emission has a maximum for wavelenghts of 8 to 10 μm.

However, the disadvantage of a passive detection apparatus is that it is possible to partially or entirely obscure such an apparatus. In order to obviate this disadvantage, the British Pat. GB 1,603,306 utilizes a system detecting an obscuring element by detecting a second infrared radiation having a wavelength of 0.9 μm emitted by an emitter.

The emitter and receiver at 0.9 μm are arranged in the same housing as the pyroelectric detector and utilize for their operation the same entrance window. The principle of this anti-obscuring device is to determine the reflection coefficient of the obscuring element. The latter may be a leaf of paper or metal, a rigid obstacle, a projection of a pulverulent product or the like. In all these cases, the light emitted at 0.9 μm by the emitter is reflected by the obscuring element and is retransmitted to the detector at 0.9 μm located in the proximity. When such an obscuring operation is detected, electronic means cause an alarm to become operative.

There are many ways in which an obscuring operation can be effected and a large number thereof are not detected at all by the apparatus described in British Pat. No. GB 1,603,306.

In fact, the obscuring element may not have a sufficient reflection coefficient (i.e. may absorb the radiation at 0.9 μm). For example, the obscuring element may be painted black. In this case, the detector at 0.9 μm will not receive or substantially not receive light and will not detect the presence of the obscuring element.

Likewise, because the emitter and the receiver are stationary with respect to each other, even if the obscuring element has a sufficient reflection coefficient, the light may be reflected away from the direction of the detector. If the obscuring element is too close to the apparatus, the chances of detecting the obscuring are not equal to zero. However, if the obscuring element is arranged at a non-neglible distance in the form of an obstacle, it is not very probable that the reflected light reaches the detector at 0.9 μm.

Now it is very easy to imagine situations in which obstacles can be arranged during a period in which the apparatus is inoperative. This will be the case in public or semi-public places in which an intruder can enter by day to obscure the detector when the system is stopped, and can return when the system will have been put in operation again for supervising then deserted places.

On the other hand, according to British Pat. No. GB 1,603,306, the apparatus will detect an absence of obscuring when no radiation at 0.9 μm will have been detected by the detector at 0.9 μm. It will thus be clear that, if either the emitter or the detector becomes defective, no signal will appear, which will be interpreted as a situation of non-obscuring.

The apparatus according to this Patent is consequently either not very reliable or inoperative in a large number of conventional situations.

SUMMARY OF THE INVENTION

It is an object of the invention to reliably detect an obscuring element in a large number of situations including the few cases which will be mentioned.

For this purpose, an intruder detector according to the invention comprises (1) means for detecting obscuring elements arranged at small and at large distances, this obscuring element modifying the intensity of the luminous fluxes traversing the window, and (2) self-verification means.

For this purpose, a passive infrared detector, an emitter and a second detector at the wavelength $\lambda_2$, for example of about 0.9 μm, are arranged in a housing disposed at a given height, for example in the neighborhood of the ceiling on a wall of a zone to be supervised. Opposite to the housing at another end of the zone to be supervised there is disposed a reflector, for example a mirror, in such a manner that the light emitted by the emitter is reflected by the mirror and returns to the second detector. The arrangement of these elements is regulated at the outset so that the luminous flux received by the detector is very accurately defined.

Thus, several situations of obscuring can be detected. Use may be made of an obscuring element absorbing or reflecting the radiation $\lambda_2$ so that the detector receives a luminous flux equal to zero (i.e. different from the expected luminous flux). Furthermore, use may be made of an obscuring element reflecting the radiation $\lambda_2$ to the detector, in which event the detector receives a luminous flux higher than the expected luminous flux.

To the output of the detector is connected a comparison device, which determines whether the luminous flux received is or is not equal to the luminous flux expected. For this purpose, an electronic window is defined which is formed from two reference values V1 and V2, between which the value of the signal received should lie. The signal emitted by the comparison device is stored in a storage element, for example a trigger circuit. If the signal emitted by the detector lies within the electronic window, it causes the output of the trigger circuit to pass to a given logic state. If on the contrary this signal does not lie within the electronic window, the output of the trigger circuit passes to the inverse logic state. In the latter case, the trigger circuit acts, for example by means of a loop circuit, upon an alarm station, which then produces an audible or visible alarm.

The radiation $\lambda_2$, which has a shorter wavelength than the radiation $\lambda_1$, is utilized for this anti-obscuring system because it is possible to obtain therefrom a directive beam which can be detected by the detector after reflection by the mirror. The beam is focused, for example, by means of lenses made either of molded plastic material or of glass.

Thus, means for detecting obscuring elements are available, whether the obscuring element lies at a small or a large distance from the housing. This obscuring element can be in the form of a pulverized product or of an obstacle reflecting or cutting off the beam.

The emitter and the second detector are arranged very close to the passive detector so that an obscuring operation of the passive detector also leads to an obscuring of the second (active) detector and of the emitter. It will be appreciated that the intruder will try to obscure only the passive detector and to leave the anti-obscuring means constituted by the emitter and the second detector in operation.

In order to reduce the effectiveness of such an intervention, according to the invention, the window is formed from a material which constitutes a filter because it stops the visible part of the spectrum and transmits the wavelengths $\lambda_2$ and $\lambda_1$. Thus, a selective obscuring of the passive detector becomes more difficult. However, in particular conditions, for example by the detailed knowledge of the material, the intruder can attempt to effect this selective obscuring.

According to the invention, the apparatus for detecting intruders further comprises a second infrared emitter operating in the proximity of the wavelength $\lambda_1$. This second emitter is situtated very close to and in front of the window on the outside of the housing. This emitter has very small dimensions with respect to the observation field of the passive detector so that it does not cut off the infrared beam emitted by the intruder.

The second emitter tests at a very small distance the operation of the passive detector and detects an obscuring of the window. This emitter is, for example, a resistor deposited by a silk screen process on a very small substrate of alumina having, for example, dimensions of 5 mm×5 mm. The emitter is made operative for a limited duration each time the apparatus for detecting intruders is switched on. This step of making operative can be validated by the result of the comparison effected by the comparison device. The result of the comparison is stored in a storage element and, when the signal emitted by the second detector is within the electronic window already defined, the storage elemet validates the step of making the second emitter operative. The output of the passive detector can then validate in an alarm station the correct state of operation of the means for detection of the obscuring.

It will be appreciated that the second emitter, when simulating the presence of an intruder, could act so that the alarm of the alarm station would operate. The latter consequently has means modifying the normal operation of the alarm station in order that during the limited starting preriod the alarm station interprets the presence of the radiation having the wavelength $\lambda_1$ as concerning a testing procedure and not as characterizing the presence of an intruder.

The description of the means for detection of obscuring just described shows that a zero luminous flux received by both detectors corresponds to an operation of obscuring the apparatus. This necessitates that all the elements of the apparatus for detecting intruders are in a correct state of operation.

For this purpose, the apparatus for detecting intruders is provided with self-verification means which test the correct state of operation of the emitters and of the detectors. For this purpose, a generator supplies an electric signal of limited duration which in accordance with a starting procedure causes the first emitter and the second detector to operate, and then the second emitter and the passive detector.

According to a first preferred embodiment, the self-verification means comprise the means for detection of obscuring just described, to which an element for validation of the starting procedure is added. This validation element is, for example, a trigger circuit which stores in the form of a logic state the result of the starting procedure operating at the paths $\lambda_1$ and $\lambda_2$. In fact, when the second detector has detected the radiation $\lambda_2$ and when the passive detector has detected the radiation $\lambda_1$, the alarm station receives the information that no obscuring has been detected and that the assembly of the components constituting the two paths is in a correct state of operation. The validation element stores this information and validates the following period corresponding to the permanent operation of the apparatus for detecting intruders.

The principle of operation is as follows. After a period of standstill, the apparatus for detecting intruders is made operative again by the user. The alarm station connected, for example by means of a loop circuit, to several different intruder detectors, transmits a starting signal to the generator. The generator supplies a pulse of a duration T. This generator makes the first emitter operative, which supplies the radiation $\lambda_2$ received by the second detector. The comparison device compares the signal emitted by the detector with the values of the electronic window. The result of the comparison is stored in a trigger circuit during the period T.

If the emitted signal is not present within the electronic window, the trigger circuit acts upon the alarm station, which makes an alarm operative. If the emitted signal is present within the electronic window, the trigger circuit validates the step of making the second emitter operative, which supplies the radiation $\lambda_1$ received by the passive detector. The signal emitted by the passive detector is stored in the validation element situated in the alarm station. At the end of the period of a duration T, according to the logic state stored by the validation element, the latter validates the step of making the passive detector permanently operative if the two paths $\lambda_1$ and $\lambda_2$ have operated correctly, or on the contrary makes the alarm of the alarm station operative if the operation of the two paths $\lambda_1$ or $\lambda_2$ has been disturbed.

The light beam having a wavelength $\lambda_2$, which is reflected by the mirror, thus constitutes an optical barrier. According to the topology of the places to be supervised and in order to increase the effectiveness of the supervision, it is possible to arrange several mirrors fulfilling identical functions disposed at different ends and at different heights of the zone to be supervised. In this case, the sequences of detection of obscuring and of selfsupervision are adapted to the number of infrared barriers thus provided. This sequencing can be obtained in the generator of electric periodical signals.

In the case in which there are N mirrors (N designating the number of mirrors), arranged at different areas of the zone to be supervised, it is advantageous to use N emitters associated with the same second detector. This is possible to the extent to which the N beams emitted by the N emitters can reach the same detector.

In this case, the generator supplies consecutively N signals of a duration T. These signals act, for example, upon a counter or a shift register which has N outputs each connected to an emitter. Thus, each emitter is separately made operative.

The comparison device arranged at the output of the single second detector detects, as before, that each optical barrier has supplied its informmation. The signal at the output of the comparison device, which is representative of a value lying within the limits of the electronic window, serves, for example, to act upon a shift register having N stages, which in this manner accounts for the N correct stages of operation of the N optical barriers. By the logic state which appears at the end of the N periods at the output of the $N^{th}$ register, the latter supplies the information about the correct state of operation of the N optical barriers and acts upon the validation element of the alarm station.

It is also possible to simultaneously use N emitters and N second detectors, in which case the validation element of the alarm station is only activated if the N optical barriers have supplied information corresponding to a correct state of operation.

The apparatus for detecting intruders just described is designed to make it difficult for an intruder to selectively obscure the passive infrared detector. According to another embodiment, in order to reach the detectors, the beams at $\lambda_2$ and $\lambda_1$ have to traverse the entrance window in such a manner that the sections of the beams through the window are substantially superimposed.

Thus, the paths of the two beams coincide at the input of the apparatus for detecting intruders so that it is impossible to obscure one without obscuring the other. The two beams are separated inside the housing by means of a dichroic mirror which reflects one of the two beams and transmits the other beam.

For example, the beam at 0.9 μm arrives, after having been reflected by the mirror arranged at the end of the zone to be supervised, at the input of the apparatus for detecting intruders on a dichroic mirror inclined with respect to the direction of the beam. The latter is thus reflected to the second detector arranged, for example, in the housing. The same self-verification means of the second emitter and of the second detector are present as before. According to this other variation, the first emitter can be arranged after the dichroic mirror within the housing very close to the passive detector so as to fulfil then only the function of the self-verification means.

According to this second variation, the means for detection of an obscuring element comprise the generator of electric signals, the second emitter, the second detector and the comparison device. The self-verification means comprise these means for detection of an obscuring element as well as the first emitter, the passive detector and the validation element. The output signal of the comparison device is stored in a trigger circuit which controls the operation of the first emitter.

Evidently, according to principles known to those skilled in the art, the passive detector can be provided with a filter which stops the low wavelengths, for example lower than 5 μm, in order to decrease noise which would appear at the output of the detector.

Likewise, the segmentation of the zones to be supervised has been indicated above as being effected by means of facetted mirrors. It is quite possible to carry out an analogous function by means of Fresnel lenses.

The second emitter and the second detector can operate at other wavelengths lying in the infrared range, for example 1.3 μm or 1.5 μm, without departing from the scope of the invention.

Likewise, it has been indicated that the reflector was preferably a mirror. However, it is also possible to utilize the reflective power of other elements, for example the walls of the zone to be supervised.

DESCRIPTION OF THE PREFERRED EMBODIMENTS

Figure 1:
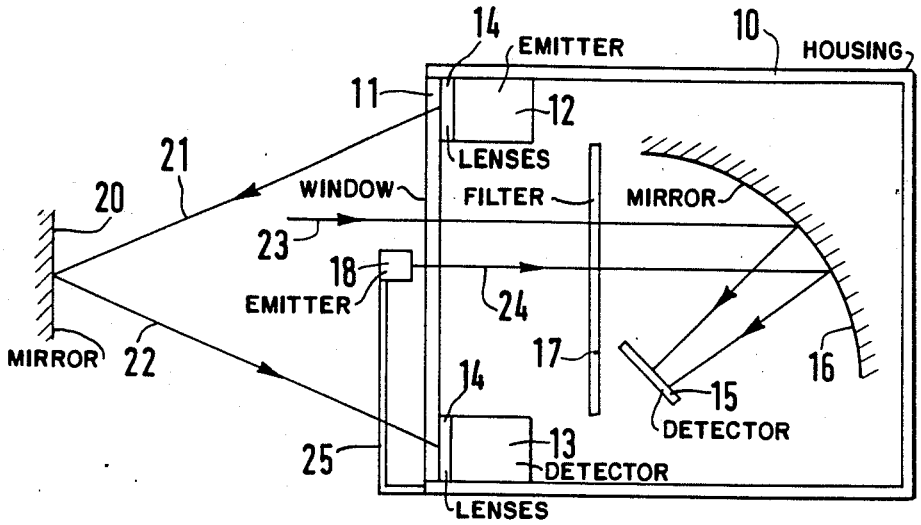
FIG. 1 is a schematic representation of an apparatus for detecting intruders according to the invention.

FIG. 1 shows an apparatus for detecting intruders comprising a housing 10 provided with a window 11. An emitter 12 and detector 13 of radiation having a wavelength $\lambda_2 \simeq 0.9$ μm are arranged inside the housing 10. Focusing lenses 14 intended to focus the beams are situated in front of the emitter 12 and the detector 13. The emitter 12 emits a beam 21 to a mirror 20 arranged at the end of the zone to be supervised.

For the sake of clarity, the mirror 20 is shown close to the housing 10, but actually it is situated at a much larger distance (that is to say at the end of the zone to be supervised). The beam 22 reflected by the mirror 20 arrives at the detector 13 through a focusing lens 14.

A passive detector 15 is located inside the housing 10 at the focus of a facetted mirror 16. Mirror 16 focuses the infrared beam emitted by the intruder. The detector 15 consequently receives through each element of the facetted mirror a beam analogous to the beam 23. The movement of the intruder generates the different beams 23.

The flux variations received by a moving intruder enable the detector 15 to detect the presence of an intruder. A high-pass filter 17 (passing wavelengths of, for example, greater than 5 μm) is arranged in front of the detector 15. This permits the detector 15 to supply at the output an electric signal in which noise has been attenuated.

The emitter 18, which emits a radiation in the proximity of the wavelength $\lambda_1$ in a beam 24, is arranged outside the housing 10 and very close to the window 11. This beam is reflected on the facetted mirror 16 so that it reaches the detector 15. The emitter 18 is rigidly fixed to the housing 10 by means of a fixing arm 25 which also carries electric connection wires. The emitter 18 has small dimensions in order not to excessively cut off the field of observation of the detector 15.

In equipment comprising several mirrors 20, these mirrors are arranged at different ends of the zone to be supervised and are orientated so that different emitters 12 supply a beam 21 on each mirror 20. Each reflected beam 22 arrives either on a single detector 13 or on several identical detectors 13 according to the arrangement of the places.

Figure 2:
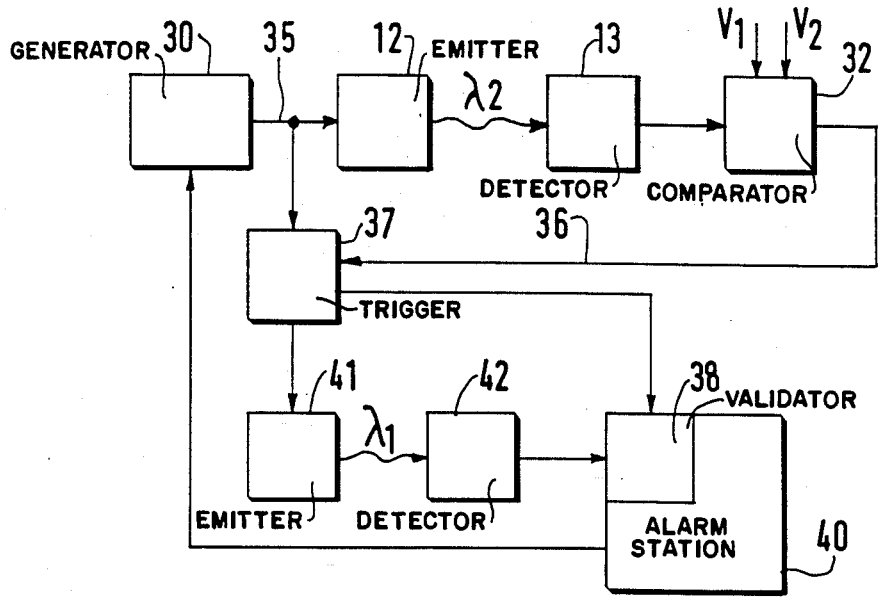
FIG. 2 is a block electric circuit diagram of the apparatus for detecting intruders.

FIG. 2 shows an electric circuit diagram of the apparatus for detecting intruders. A generator 30 of an electric signal of a duration T energizes the emitter 12, whose emitted radiation is detected by the detector 13. The output of detector 13 enters a comparison device 32.

The comparison device (comparator) 32 receives the output signal of the detector 13 and compares it with two reference values V1 and V2. When the output signal of the detector 13 lies between these two values, the comparison device 32 supplies a signal corresponding, for example, to the logic signal "1". Likewise, when the output signal of the detector 13 lies outside this window of values, the comparison device 32 supplies a signal corresponding to the logic state inverse to the preceding state (i.e. "0" in this example).

Figure 3:
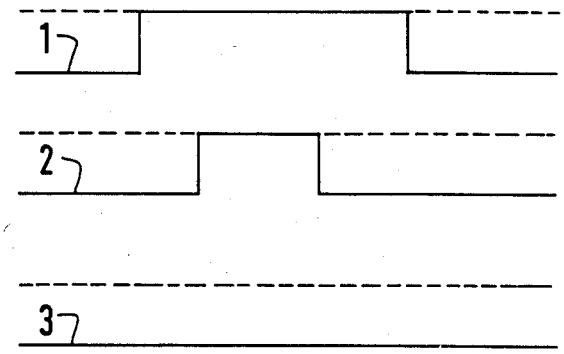
FIG. 3 is a time diagram for the signals detected with or without an obscuring element.

This test is performed for a limited period T. The time diagram for these different signals is shown in FIG. 3. The signals present at the lines 35 and 36 of FIG. 2 are represented in FIG. 3 by the reference symbol 1 and the reference symbols 2 and 3, respectively, depending upon whether an obscuring element has not been or has been detected.

The signal 1 indicates that for a limited duration T the emitter 12 is operative. If no obscuring has taken place, the signal 2 of FIG. 3 appears at the connection 36, that is to say that the logic signal "1" has been emitted by comparison device 32. If on the contrary the signal 3 of FIG. 4 appears at the line 36, radiation $\lambda_2$ has not been detected. Therefore, emitter 12 of detector 13 is defective, or an obscuring element has been detected.

In the latter case, the output of the trigger circuit 37 operates the alarm of the alarm station 40 by means of the validation element (validator) 38.

When no obscuring has been detected, the trigger circuit 37 makes the emitter 41 operative, which supplies infrared radiation $\lambda_1$. Radiation $\lambda_1$ is detected by the detector 42. The output signal of the latter arrives at the validation element 38. If a signal has not been detected by the detector 42, the validation element operates the alarm of the alarm station 40.

If on the contrary a signal has been detected, the validation element 38 validates the end of the period of limited duration T. This results in that the alarm station is given back its autonomy to intervene in the case of detection of a radiation having a wavelength $\lambda_1$ by the detector 41. The apparatus for detecting intruders is then in its permanent state of operation for detecting an intruder.

The procedure just described is effected each time the apparatus is made operative. It is possible to repeat this procedure sequentially in order that the self-verification operations are effected, which are carried out according to a similar procedure bringing to light a defect, the appearance of which cannot be detected by the detector 42.

Figure 4:
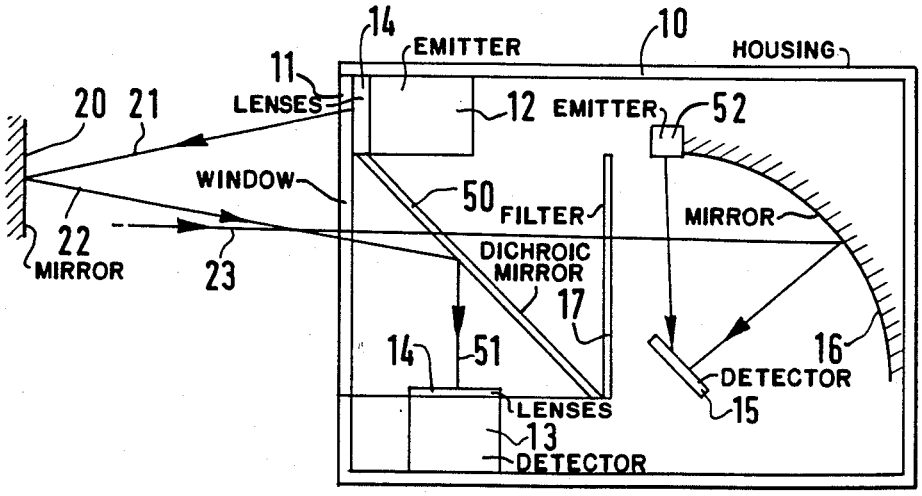
FIG. 4 is a schematic representation of another variation of the apparatus for detecting intruders comprising a dichroic mirror.

FIG. 4 shows a second variation of the apparatus for detecting intruders. It differs from the preceding embodiment by the dichroic mirror 50 arranged behind the entrance window 11. The reflected light beam 22 emitted by the emitter 12 is reflected by the dichroic mirror 50 along path 51 which arrives on the detector 13. The entrance surface of detector 13 is on the path 51.

On the other hand, the beam 23 emitted by the intruder traverses the dichroic mirror 50. Beam 23 then arrives on the detector 15 after having been reflected by the facetted mirror 16. The two beams are therefore dissociated as a function of their wavelength.

The beams 22 and 23 traverse substantially the same part of the entrance window 11. Any obscuring of the window will affect both beams.

In this case, an emitter 52 is arranged inside the housing for the self-verification function. The electrical operation remains unchanged.

According to measures known to those skilled in the art, the facetted mirror segmenting the scrutinization of the zone to be supervised may be replaced by a Fresnel lens. In this case, the Fresnel lens is arranged behind the high-pass filter 17 substantially at right angles to the beam 23. The detector 15 then faces the direction of arrival of the beam 23.

What is claimed is:

1. An apparatus for detecting an intruder in a zone to be supervised, said apparatus comprising:

a housing having a window, said housing being arranged at the first end of the zone to be supervised;

a passive infrared detector arranged in the housing to receive infrared radiation passing through the window, said passive detector detecting radiation around a wavelength $\lambda_1$ and generating an output signal in response thereto;

an emitter for emitting infrared radiation around a wavelength $\lambda_2$, $\lambda_2$ being different from $\lambda_1$;

a second infrared detector arranged in the housing to receive infrared radiation passing through the window, said second detector detecting radiation around a wavelength $\lambda_2$ and generating an output signal in response thereto;

a reflector arranged at an end of the zone to be supervised opposite the housing; said reflector being arranged to receive infrared radiation from the emitter and to reflect said infrared radiation onto the second infrared detector;

means for causing the emitter to emit infrared radiation of wavelength $\lambda_2$; and means for comparing the output signal of the second detector with first and second reference values, the first reference value being less than the second reference value, said comparison means activating an alarm if the output signal is less than the first reference value or if the output signal is greater than the second reference value.

2. An apparatus as claimed in claim 1, further comprising:

a second light emitter for emitting infrared radiation around a wavelength $\lambda_1$, said second light emitter being arranged in front of the window outside the housing to radiate infrared radiation onto the passive detector;

means for momentarily energizing the second light emitter one time only when the apparatus is turned on; and means for activating an alarm if the passive detector produces no output signal when the second light emitter is energized.

3. An apparatus as claimed in claim 2, characterized in that the means for causing the first emitter to emit infrared radiation of wavelength $\lambda_2$ momentarily energizes the first light emitter one time only when the apparatus is turned on.

4. An apparatus as claimed in claim 1, further comprising a dichroic mirror arranged in the housing to receive infrared radiation of wavelength $\lambda_1$ and $\lambda_2$ passing through the window, said dichroic mirror transmitting infrared radiation of one wavelength $\lambda_1$ or $\lambda_2$, and reflecting infrared radiation of the other wavelength.

5. An apparatus as claimed in claim 4, characterized in that the means for causing the first emitter to emit infrared radiation of wavelength $\lambda_2$ momentarily energizes the first light emitter one time only when the apparatus is turned on.

6. An apparatus as claimed in claim 1, characterized in that the means for causing the first emitter to emit infrared radiation of wavelength $\lambda_2$ momentarily energizes the first light emitter one time only when the apparatus is turned on.

* * * * *